US005784915A

United States Patent [19]

Allemann et al.

[11] Patent Number: 5,784,915

[45] Date of Patent: Jul. 28, 1998

[54] MACHINE FOR BENDING SHEET METAL MARGINS

[75] Inventors: Marco Allemann, Untervaz; Andreas Janutin, Chur, both of Switzerland

[73] Assignee: Trumpf GmbH & Co., Ditzengen, Germany

[21] Appl. No.: 837,370

[22] Filed: Apr. 17, 1997

[30] Foreign Application Priority Data

Apr. 16, 1996 [DE] Germany ..... 296 06 725 U

[51] Int. Cl.[6] ..... B21D 17/10

[52] U.S. Cl. ..... 72/211; 29/243.5; 72/51

[58] Field of Search ..... 72/51, 52, 210, 72/211; 29/243.5, 243.58, 243.57

[56] References Cited

U.S. PATENT DOCUMENTS

| | | | |
|---|---|---|---|
| 2,146,659 | 2/1939 | Stewart | 72/211 |
| 2,637,292 | 5/1953 | George, Jr. | 72/211 |
| 2,919,613 | 1/1960 | Crement | 72/210 |
| 2,998,738 | 9/1961 | Crine, Sr. et al. | 72/51 |

*Primary Examiner*—Joseph J. Hail, III
*Assistant Examiner*—Rodney Butler
*Attorney, Agent, or Firm*—Pepe & Hazard LLP

[57] ABSTRACT

On a machine for bending a sheet-metal edge (4) provided with a first sheet metal part (2) over a second sheet metal part (3) to be connected to the first (2), with at least one pair (12, 15) of form rollers, preferably driven, whose form rollers (13, 14; 16, 17) roll over it in the feed direction (19) on opposite sides of the sheet-metal edge (4) along its longitudinal edge and whose roll gap (20, 22) in the bending direction is inclined toward the second sheet metal part (3), wherein one of the form rollers (14, 17) grasps the sheet-metal edge (4) underneath on the side facing the second sheet metal edge (3), and with a support going across the feed direction (19) with at least one abutment supported on one of the sheet metal parts (2,3) by the fact that the abutment(s) is (are) arranged lagging behind the pair (12) of form rollers in the feed direction (19) and is (are) supported on the side of the sheet-metal edge (4) facing the second sheet metal part (3). This prevents unwanted deformations and damage to the sheet metal parts (2, 3).

23 Claims, 4 Drawing Sheets

MACHINE FOR BENDING SHEET METAL MARGINS

BACKGROUND OF THE INVENTION

The invention concerns a machine for bending a sheet-metal edge with a first part over a second part connected to the first with at least one pair of form rollers, preferably driven, whose rollers roll over it along its longitudinal edge in the feed direction on opposite sides of the sheet-metal edge and whose roll gap is inclined in the bending direction toward the second part of the sheet metal, wherein one of the rollers grasps the sheet-metal edge underneath on the side facing the second sheet-metal part, and with a support crosswise to the feed direction with at least one abutment supported on one of the sheet-metal parts.

Such a machine is known as a folding machine for producing so-called Pittsburgh folds. These are corner folds, like those on the air ducts of air-conditioning and/or ventilation units that are square in cross section and are made of sheet metal. To save transport volume, such air ducts are delivered to the mounting site in individual pieces. And at least one part of the duct wall is folded roughly in an S shape to form a pocket that extends in the longitudinal direction of the duct. A wall element joining the folded wall piece is beveled at right angles and is pushed into the pocket described form by an S curve in the wall part to mount the air duct. The edge of the folded wall piece that goes over the S curve forming the pocket projects over the wall element beveled on its longitudinal edge. Lastly, this projecting edge of the sheet metal is folded toward the wall part hitting the sheet-metal edge at basically a right angle to produce the fold connection by means of a common folding machine and is pressed against it. For this purpose, the folding machine is set on the sheet-metal edge running first roughly perpendicular to the wall element bordering it and runs along it in the feed direction, i.e., longitudinal direction of the sheet-metal edge. Because of the inclined position of their roll gap, the rollers in the pair of form rollers rolling over the edge of the sheet metal cause the sheet-metal edge to bend toward the beveled wall element. As a result of the counter forces produced to the bending forces, the form rollers are forced to leave the desired plane of movement running in the feed direction and basically perpendicular to the sheet-metal edge toward the free longitudinal edge, which is in the starting position. To prevent this type of deviation in direction, which affects the success of the machining, generic machines use the support mentioned at the beginning with at least one abutment.

On the previously known folding machine, a cylindrical supporting roller is used as the abutment, and it is placed on one of the brackets projecting from the basic body of the machine. In the working position, the previously known machine is stretched over the corner of the air duct to be put together and overlaps it. In this way, the machine runs on one side of the duct corner over the rollers on the sheet-metal edge to be folded and is supported on the other side of the duct corner by the supporting roller on the wall part of the air duct. Hence, the supporting roller, according to the purpose for which it is used, can prevent the folding machine from breaking out the desired plane of movement, if its axis of rotation is aligned at a sharp angle to the duct wall. When the folding machine moves in the feed direction, the supporting roller then rolls with its generating edge running in the peripheral direction of its basic surface and forming a sharp edge on the duct wall. It goes into a groove-type gap running longitudinally to the duct wall which was formed when the wall part in question was folded. Since the gap available for engagement is very narrow, the sharp edge of the supporting roller can only be narrow. In addition, the supporting roller must be adjustable in order to be able to balance the tolerances that occur when the pocket is bent. The tensile force by means of which the folding machine is held in the corner of the air duct is introduced into the duct wall by the sharp edge of the supporting roller. As a result of the contact between the sharp edge of the supporting roller and the duct wall, with the force simultaneously acting on the supporting roller, when the previously known folding machine was used, this caused unwanted deformations and damage to the duct wall along the path of movement of the supporting roller.

The task of this invention is to fix this disadvantage.

SUMMARY OF THE INVENTION

The invention solves this task by arranging an abutment (s) to the pair of form rollers lagging in the feed direction on a machine of the type mentioned at the beginning and supported on the side of the sheet-metal edge facing the second part of the sheet metal. In the case of such a machine, the support for guaranteeing the desired path of movement of the machine is moved out of areas where there could be deformation and damage and the function or appearance of the sheet metal parts being connected could be affected by deformation and damage. Using the inclined edge of the sheet metal corresponding to the path of the roller gap as an abutment opens up the possibility of flat support of the machine, without having to provide a groove-type engagement for the abutment or abutments in the wall of one of the sheet metal pieces to be connected together. Unwanted formations and damage on the edge of the sheet metal as a result of the supporting forces that are introduced are prevented by flat transmissions of forces. In cases in which there are deformations and/or damage, the function of the component, consisting of the sheet metal parts being connected is not affected, since the areas of the sheet metal part adjacent to the sheet-metal edge used only as a connecting element remain undamaged in any case. Also, deformations and, for example, surface damage occur, if necessary, on that side of the edge of the sheet metal that after folding comes to rest on the assigned sheet metal part, and therefore after machining is covered and is placed so it cannot be seen from the outside. The advantages described occur for example on the machines in the invention in the form of folding machines and on machines according to the invention that are generally used for beading a projecting sheet-metal edge on a second sheet metal part.

For this purpose, the invention provides that the support have at least one guide shoe supported on the sheet-metal edge as the abutment.

A way of introducing the supporting forces to be transmitted that prevents damage and/or deformation in the area of the sheet-metal edge is achieved in the case of one preferred version of the invention by the fact that the guide shoe(s) is (are) supported on a sliding surface on the sheet-metal edge.

In addition to or alternately to one or more guide shoes, in another form of embodiment of the machine in the invention, there is at least one abutment roller rolling over the edge of the sheet metal in the feed direction as an abutment of the support. The resistance to movement opposed to the feed of the machine by its support is reduced by using supporting rollers, compared to forms of embodiment with guide shoes.

One preferred version of the invention is characterized by the fact that a roller of a second form-roller apparatus is provided as the abutment roller, which is arranged lagging behind the first pair of form rollers in the feed direction and whose form rollers roll over it in that direction on opposite sides of the sheet-metal edge, wherein the roll gap of the second pair of form rollers in the bending direction is inclined preferably more toward the second sheet metal part than the roller gap of the first pair of form rollers. In this case, the second pair of form rollers can be used as a component of the machine support and can thus have a dual function. If its roll gap is inclined more than the roll gap of the leading pair of rollers, this helps to make the sheet-metal edge bent by the leading first pair of form rollers in a first machining step in the direction of the second sheet metal part move closer to the second sheet metal part; at the same time, the form roller going under the edge of the sheet metal of the second pair of form rollers does the job of the abutment that keeps the machine from breaking away.

One multiple, and hence particularly effective support of the machine, comes from a variation of the invention that uses two pairs of form rollers arranged one behind the other in the feed direction, due to the fact that the abutment of the support includes at least one guide shoe arranged between the pairs of form rollers in the feed direction and/or at least one guide shoe arranged lagging behind the second pair of form rollers.

Basically, cylindrical form rollers can be used on the machines in the invention; their axes of rotation can then run parallel to the roll gap. But according to the invention, one form of embodiment is preferred in which the form rollers of the first and/or the form rollers of the second pair of form rollers are designed conically. In this case, the axes of rotation of the form rollers run perpendicularly to the feed direction.

Generic machines are known which have a guide plate that lies on the second sheet metal part and can move with the machine in the feed direction. Such a machine is changed in the sense of the invention in that at least one projection projecting from the guide plate to the edge of the sheet metal is provided as the abutment of the support.

When there is bending toward the second sheet metal part, elastic return forces are produced on the sheet-metal edge, because of which the sheet-metal edge is forced to spring back in the direction of its starting position. These return movements are further enhanced by the use of abutments according to the invention, whereby the supporting forces to be introduced are introduced on the sheet-metal edge supporting the return movement. In order to avoid such return movements, which are detrimental to machining success, the invention provides that at least one form roller arranged on the side of the sheet-metal edge facing away from the abutment of the support lies on said side with a supporting piece outside the sheet-metal edge on the first sheet metal part that has the edge. The supporting piece keeps the bent sheet-metal edge from moving in the direction of its starting position.

In the case of the machines in the invention, in which at least one form roller arranged on the side of the sheet-metal edge on the side facing away from the abutment of the support is designed conically; a supporting cylinder projecting in the axial direction from the form roller(s) serves as the supporting piece.

To guarantee effective support of the machine even when the sheet metal thicknesses change, one version of the invention has at least one abutment of the support that can be adjusted perpendicular to the sheet-metal edge.

Also to adjust the machine to changing sheet metal thicknesses, in another variation of the invention, the form rollers of at least one pair of form rollers, especially the form rollers of the pair of form rollers used as an abutment of the support, can be adjusted to set the width of the roll gap in the crosswise direction of the sheet-metal edge relative to one another. This feature also makes it possible to set the machine anywhere on the sheet-metal edge or take it off anywhere on the sheet-metal edge. Here the form rollers can preferably be adjusted relative to one another by means of an adjustment device.

Automatic adjustment of the roll gap to changing sheet metal thicknesses, for example in the case of measurement tolerances on one and the same sheet metal part is made possible by the invention on a machine on which at least one form roller of at least one pair of form rollers is spring-mounted in the direction crosswise to the edge of the sheet metal.

On generic machines, a pressure device can be used to put pressure on the sheet-metal edge of the first part bent by means of the form rollers to finish the machining process on the second sheet metal part. On known machines, a sliding block moved with the machine in the feed direction is used for this purpose. Such machines are developed by the invention in that a cylindrical roller is provided as the pressure device that lags behind the form rollers and the abutment(s) of the support in the feed direction, whose axis runs parallel to the plane of the second sheet metal part. The inclination of the machine leaving the desired path of movement when a cylindrical roller is used as the pressure device is less than when a sliding block is used. This simplifies support of the machines in the invention on the edge of the sheet metal.

BRIEF DESCRIPTION OF THE DRAWINGS

The invention will be explained in greater detail below using schematic drawings of one example of embodiment.

DETAILED DESCRIPTION OF THE ILLUSTRATED EMBODIMENT

Figure 1:
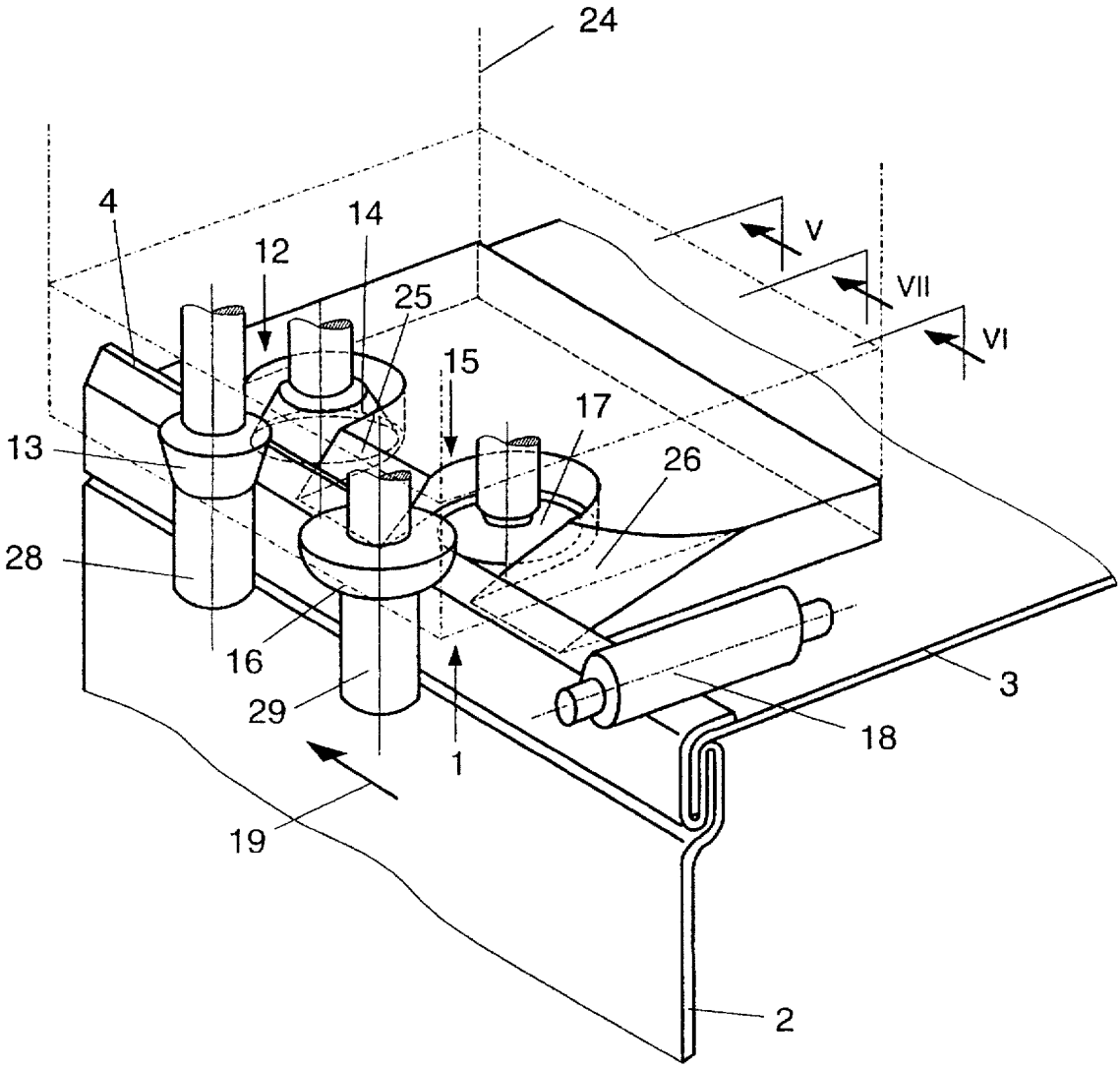
FIG. 1 shows a schematic drawing of the basic components of a folding machine.

According to FIG. 1, a folding machine 1, whose basic body or frame 24 is indicated in dashes is used to produce an air duct that is square in cross section. A fold connection is to be produced here between a first sheet metal part 2 and a second sheet metal part 3.

Figure 2:
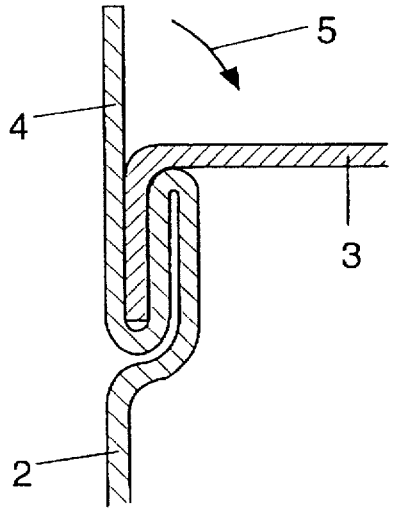
FIG. 2 shows an open Pittsburgh fold.
Figure 3:
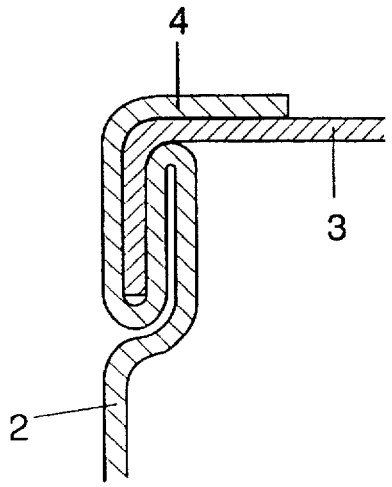
FIG. 3 shows a closed Pittsburgh fold.

In the example shown, the connection is made by a Pittsburgh fold, as can be inferred from FIGS. 2 and 3 in its principal layout.

As FIGS. 2 and 3 show, the first sheet metal part 2 is folded in an S shape forming a pocket that runs in the longitudinal direction of the air duct. The second sheet metal part 3 is folded at a right angle and pushed into the pocket formed by an S curve in the first sheet metal part 2 to produce the fold connection at first with its folded edge. To secure the interlocking connection obtained thereby, one edge 4 of the first sheet metal part 2 projecting over the second is bent in the direction of the arrow 5 toward the second sheet metal part 3 and pressed against it. The fold connection produced is shown in FIG. 3.

Figure 4:
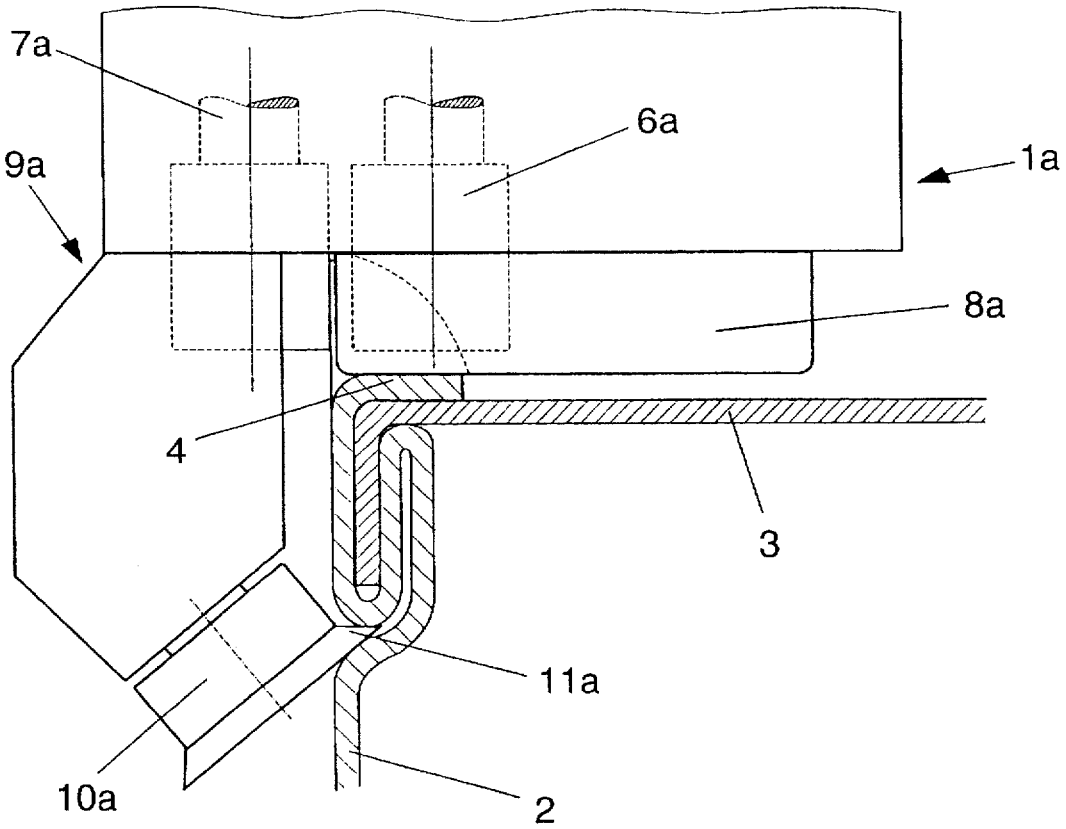
FIG. 4 shows a state-of-the-art folding machine.

To produce the fold connection in the way described, the state of the art discloses a folding machine 1*a*, as sketched in FIG. 4.

This previously known folding machine 1*a* is equipped with a pair of drive rollers 6*a*, 7*a* which lie on the sheet-metal edge 4 under pressure on opposite sides. Driven by means of an electric motor, the drive rollers 6*a*, 7*a* move the folding machine 1*a* in a feed direction for the machine, i.e., in a longitudinal direction of the sheet-metal edge 4 along which the machine will be moved. There is a pair of form rollers, not shown in greater detain, on the folding machine 1*a* lagging behind the driver rollers 6*a*, 7*a* in the feed direction, whose roll gap or nip is inclined toward the second sheet metal part 3 compared to the starting position of the sheet-metal edge 4 shown in FIG. 1 and forms a sharp angle with it. In the feed direction behind the pair of form rollers, in turn, there is a sliding block 8*a* with an inclined surface on the front facing the pair of form rollers.

To produce the fold connection, the folding machine 1*a* in the position shown in FIG. 4 is put on the edge 4 of the first part 2 of the sheet metal. The drive rollers 6*a*, 7*a* draw the folding machine 1*a* in the feed direction on the sheet-metal edge 4. The part of the sheet-metal edge 4 coming out of the roll gap of the drive rollers 6*a*, 7*a* runs in the roll gap or nip of the pair of form rollers and is thus bent in accordance with the inclination of this roll gap or nip toward the second part 3 of the sheet metal. Finally, the sliding block 8*a* lagging behind the pair of form rollers presses sheet-metal edge 4 running inclined against the second sheet-metal part 3 at a sharp angle after leaving the roll gap or nip of the pair of form rollers onto the surface of the second part 3 of the sheet metal into the position shown in FIG. 3.

Reaction forces are associated with the bending forces applied, as a result of which the folding machine 1*a* is forced to move to the upper end of sheet-metal edge 4 in FIG. 4. A support 9*a* with a supporting roller 10*a* keeps the folding machine *1a* from breaking away from its path of movement, which is not desired. When the folding machine 1*a* makes a feed movement, the supporting roller rolls with a sharp edge 11*a* onto the first sheet metal part 2 and thus engages with the edge 11*a* in a groove-like longitudinal depression on the first sheet metal part 2 produced by the folding. The supporting roller 10*a* accordingly forms an abutment for the folding machine 1*a*, by means of which the folding machine 1*a* is kept from leaving its planned path of movement.

Figure 5:
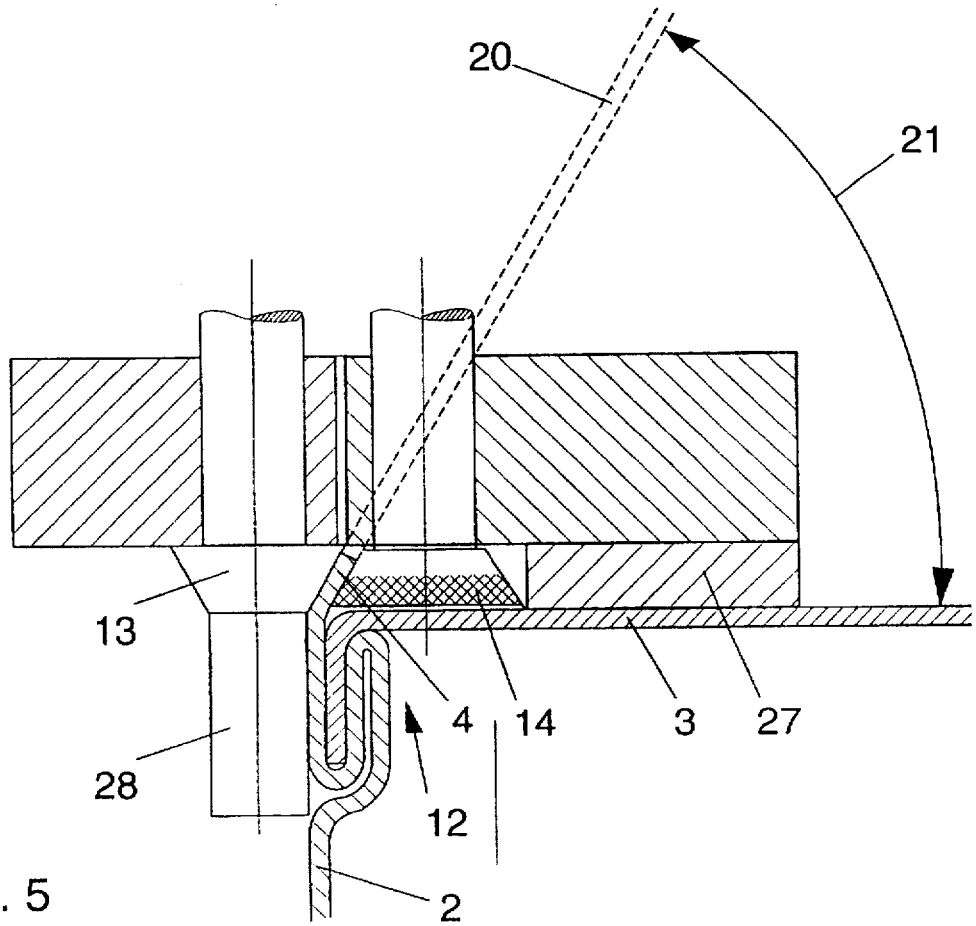
FIG. 5 shows a sectional representation of the folding machine in FIG. 1 in cutting plane V.
Figure 6:
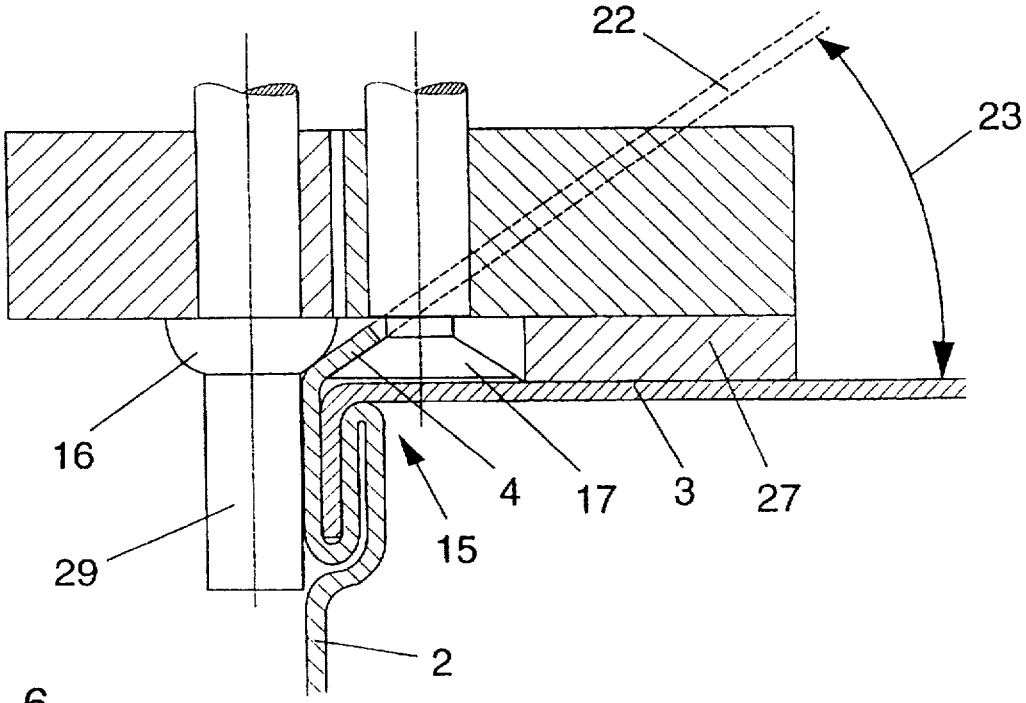
FIG. 6 shows a sectional representation of the folding machine in FIG. 1 in cutting plane VI.
Figure 7:
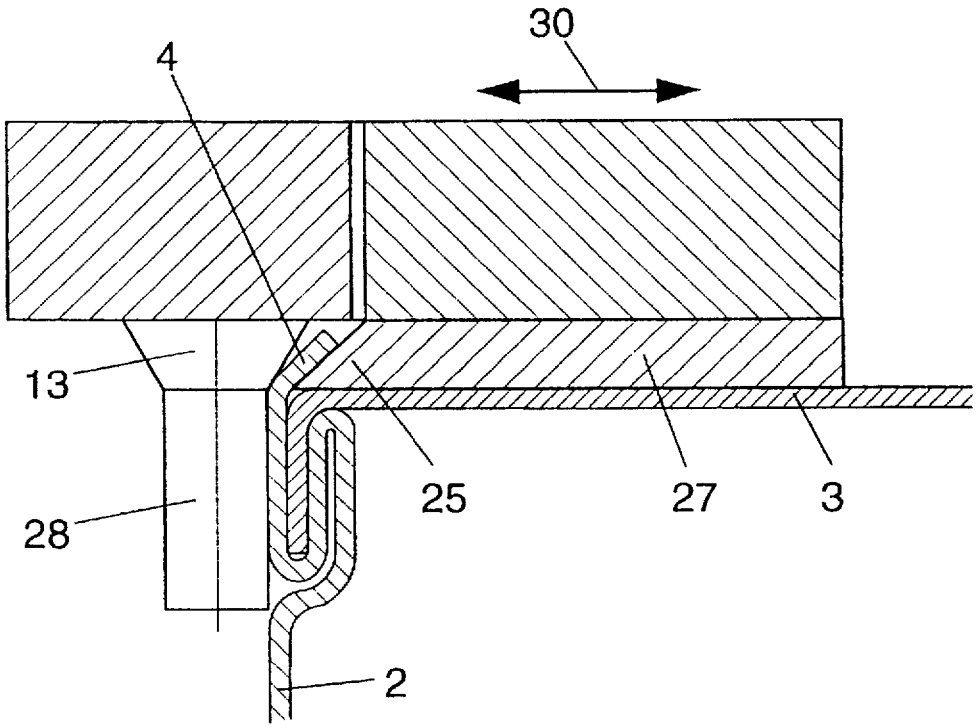
FIG. 7 shows a sectional representation of the folding machine in FIG. 1 in cutting plane VII.

To produce the fold connection, the folding machine 1 in the invention, shown in detail in FIGS. 5 to 7, makes use of a first driven pair 12 of form rollers consisting of conical form rollers 13, 14, a second pair of form rollers 15 with form rollers 16, 17 conically designed and also driven, and a pressure roller 18.

By means of the driven form rollers 13, 14; 16, 17, the folding machine 1 is moved in the feed direction 19 along the longitudinal edge of the sheet metal 4. The form rollers 13, 14; 16, 17 of the first pair of form rollers 12 and the second pair of form rollers 15 roll on opposite sides of the sheet-metal edge 4. Corresponding to the direction 19 of the folding machine 1, the sheet-metal edge 4 in the vertical starting position runs into a roll gap or nip 20 of the first pair of form rollers 12. The roll gap or nip 20 forms a sharp angle 21 with the plane of the second sheet metal part 3. The sheet-metal edge 4 is bent out of its vertical starting position by means of form rollers 13, 14 into a corresponding position opposite the second sheet metal part 3. The resultant alignment of the sheet-metal edge 4 is shown in FIG. 5.

After leaving the roll gap or nip 20, the sheet-metal edge 4 inclined against the plane of the second part 3 runs at an angle 21 into a roll gap or nip 22 between the form rollers 16, 17 of the second pair of form rollers 15. The roll gap or nip 22 is inclined more toward the plane of the second part 3 of the sheet metal than the roll gap or nip 20 the sheet-metal edge 4 previously ran through. As shown in FIG. 6, the roll gap or nip 22 forms a sharp angle with the plane of the second sheet metal part 3, which is roughly half as large as the sharp angle 21 between the central axis of the roll gap or nip 20 and the plane of the second sheet metal part 3.

After leaving the roll gap 22, sheet-metal edge 4 inclined against the plane of the second sheet metal part 3 is acted on by the pressure roller 18 and pressed onto the surface of the second sheet metal part 4 into its bending end position, in which the fold connection is closed.

The reaction forces produced by the bending forces applied in the forming process described, because of which the folding machine 1 is forced to leave its plane of movement parallel to the plane of the second sheet metal part 3 and move toward the free longitudinal edge of the sheet-metal edge 4, are introduced into it on the side of sheet-metal edge 4 facing the second sheet metal part 3. A support for the folding machine with several abutments is used for this purpose. The abutments provided are projections 25, 26 on a guide plate 27 connected to the basic body 24 of the folding machine 1 and lying on the second sheet metal part 3. The projections 25, 26 form guide shoes, which grasp the sheet-metal edge 4 behind when the folding machine moves in the feed direction 19 on the side facing the second sheet metal part 3. The form roller 17 of the second pair of form rollers 15 serves as an abutment of the support for the folding machine 1, and, along with the roll edge on its conically expanded end, reaches up to almost the area of the forward folding of the sheet-metal edge 4 compared to the remaining first sheet metal part 2 and grasps the sheet-metal edge 4 way underneath.

When the sheet-metal edge 4 is bent toward the second sheet metal part 3, return forces occur on the sheet-metal edge 4, as a result of which the sheet-metal edge 4 is forced to spring back in the direction of its starting position. Cylindrical supporting pieces 28, 29 on the form rollers 13, 16 serve to introduce these return forces into the first sheet metal part 2. These supporting pieces 28, 29 prevent the sheet-metal edge 4 from making a pivoting outward movement from the positions shown in FIGS. 5 to 7 in the direction of its starting position.

To adjust the folding machine to changing sheet metal thicknesses, the form rollers 13, 14; 16, 17 of the pair of form rollers 12, 15, as shown with arrow 30 in FIG. 7, can be adjusted relative to one another in the direction crosswise to the sheet-metal edge 4. A spring mount of a form roller of the pair of two form rollers 12, 15 that acts in that direction is used to automatically adjust the width of the roll gap or nip 20, 22 to changing sheet metal thicknesses.

We claim:

1. In a machine for joining overlapping edge portions of two sheet metal parts, a first part having an edge portion extending perpendicularly to a body portion of said first part and an edge portion of a second part being generally S-shaped with said perpendicular edge portion of said first part extending between said outer sections of said S-shaped portion of said first part, the outermost section of said S-shaped portion having a projecting portion extending above a plane of said body portion of said first part, said machine comprising:

(a) a frame;

(b) a first pair of cooperating rollers rotatably mounted on said frame for rotation about parallel axes and having oppositely inclined conical forming surfaces defining a roll nip therebetween extending in a plane oriented at an acute angle to said axes of rotation;

(c) a second pair of cooperating rollers spaced from said first pair of rollers and rotatably mounted on said frame for rotation about parallel axes aligned with and parallel to said axes of said first pair, said second pair having oppositely inclined generally conical forming surfaces defining a roll nip therebetween extending in a plane oriented at an acute angle to said axes of rotation which is greater than the angle of the nip in said first pair, at least one roller of each pair of cooperating rollers being rotatably driven;

(d) an abutment member on said frame disposed between said first and second pairs of rollers having a surface inclined at an angle approximating the angle of said nip of said first pair of rollers, and said machine is oriented with its abutment member extending along said body portion of said first part and said roll forming surfaces of said first pair of rollers being disposed on opposite sides of said projecting portion of said outermost section to bend the projecting portion of said second part toward said body portion of said first part as the machine is moved along overlapping edge portions and said abutment surface provides a guide for the bent portion of said outermost section; and (e) a pressure roller rotatably mounted on said frame at a point spaced from said second pair for rotation about an axis perpendicular to said axes of said pairs of forming rollers to press said folded extending portion of said second part against the surface of said body portion of said first part.

2. The machine in accordance with claim 1 wherein said abutment member is provided as a guide shoe mounted on said frame, said guide shoe having a generally planar surface for sliding along a surface of said first part.

3. The machine in accordance with claim 1 wherein said machine include an adjustment device for adjusting the spacing between said rollers.

4. The machine in accordance with claim 1 wherein the outer roller of each of said first and second pairs includes a cylindrical portion adjacent said conical forming surface bearing against an outer surface of the outermost section of said second part below said projecting portion to resist return forces acting on said second part.

5. The machine in accordance with claim 2 wherein said guide shoe is slidable on said frame to vary a spacing between the nips of said first and second pairs of rollers and its adjacent surface.

6. The machine in accordance with claim 2 wherein a second guide shoe is supported on said frame on the opposite side of said second pair of rollers, said rollers being mounted on said frame so that a spacing between said rollers of each of first and second pairs may be adjusted to vary dimension of said roll nips.

7. In a machine for joining overlapping edge portions of two sheet metal parts, a first part having an edge portion extending perpendicularly to body portion of said first part and an edge portion of a second part being generally S-shaped with said perpendicular edge portion of said first part extending between outer sections of said S-shaped portion of said second part, the outermost section of said S-shaped portion having a projecting portion extending above a plane of said body portion of said first part, said machine comprising:

(a) a frame;

(b) a first pair of cooperating rollers rotatably mounted on said frame for rotation about parallel axes and having oppositely inclined conical forming surfaces defining a roll nip therebetween extending in a plane oriented at an acute angle to said axes of rotation;

(c) a second pair of cooperating rollers spaced from said first pair of rollers and rotatably mounted on said frame for rotation about parallel axes aligned with and parallel to said axes of said first pair, said second pair having oppositely inclined generally conical forming surfaces defining a roll nip therebetween extending in a plane oriented at an acute angle to said axes of rotation which is greater than the angle of the nip in said first pair; and (d) an abutment member on said frame disposed between said first and second pairs of rollers having a surface inclined at an angle approximating the angle of said nip of said first pair of rollers, and said machine is oriented with its abutment member extending along said body portion of the first part and said roll forming surfaces of said first pair of rollers being disposed on opposite sides of said projecting portion of said outermost section to bend the projecting portion of said second part toward said body portion of said first part as the machine is moved along said overlapping edge portions and said abutment surface provides a guide for the bent portion of said outermost section.

8. The machine in accordance with claim 7 wherein said abutment member is provided as a guide shoe mounted on said frame.

9. The machine in accordance with claim 7 wherein said rollers are mounted on said frame so that a spacing between said rollers of each pair is adjusted to vary the dimension of said roll nips.

10. The machine in accordance with claim 7 wherein the outer roller of each of said pairs of rollers includes a cylindrical portion adjacent said conical forming surface bearing against an outer surface of the outermost section of said second part below the projecting portion to resist return forces acting on said second part.

11. The machine in accordance with claim 7 wherein there is included a pressure roller rotatably mounted on said frame at a point spaced from said second pair of rollers for rotation about an axis perpendicular to said axes of said pairs of forming rollers to press a folded extending portion of said second part against a surface of the body portion of said first part.

12. The machine in accordance with claim 7 wherein at least one roller of each of said first and second pairs of rollers is rotatably driven.

13. The machine in accordance with claim 8 wherein said guide shoe has a generally planar surface for sliding along a surface of said first part.

14. The machine in accordance with claim 8 wherein a second guide shoe is supported on said frame on an opposite side of said second pair of rollers.

15. The machine in accordance with claim 13 wherein said guide shoe is slidable on said frame to vary a spacing between the nips of said rollers and its adjacent surface.

16. The machine in accordance with claim 9 wherein said machine include an adjustment device for adjusting the spacing between said rollers.

17. In a machine for joining the overlapping edge portions of two sheet metal parts, a first part having an edge portion extending perpendicularly to a body portion of said first part and an edge portion of a second part being generally S-shaped with said perpendicular edge portion of said first part extending between the outer sections of said S-shaped portion of said second part, the outermost section of said S-shaped portion having a projecting portion extending above a plane of said body portion of said-first part, said machine comprising:

(a) a frame;

(b) a first pair of cooperating rollers rotatably mounted on said frame for rotation about parallel axes and having oppositely inclined conical forming surfaces defining a roll nip therebetween extending in a plane oriented at an acute angle to said axes of rotation;

(c) a second pair of cooperating rollers spaced from said first pair of rollers and rotatably mounted on said frame for rotation about parallel axes aligned with and parallel to said axes of said first pair, said second pair having oppositely inclined generally conical forming surfaces defining a roll nip therebetween extending in a plane oriented at an acute angle to said axes of rotation which is greater than the angle of the nip in said first pair, at least one roller of each pair of cooperating rollers being rotatably driven; and (d) an abutment member on said frame disposed between said first and second pairs of rollers having a surface inclined at an angle approximating the angle of said nip of said first pair of rollers, and said machine is oriented with its abutment member extending along said body portion of said first part and said roll forming surfaces of said first pair of rollers being disposed on opposite sides of said projecting portion of said outermost section to bend the projecting portion of said second part toward said body portion of said first part as the machine is moved along said overlapping edge portions and said abutment surface provides a guide for the bent portion of said outermost section.

18. The machine in accordance with claim 17 wherein said abutment member is provided as a guide shoe mounted on said frame.

19. The machine in accordance with claim 17 wherein a second guide shoe is supported on said frame on an opposite side of said second pair of rollers.

20. The machine in accordance with claim 17 wherein said rollers are mounted on said frame so that a spacing between said rollers of each pair is adjusted to vary the dimension of said roll nips.

21. The machine in accordance with claim 18 wherein said guide shoe has a generally planar surface for sliding along a surface of said first part.

22. The machine in accordance with claim 21 wherein said guide shoe is slidable on said frame to vary a spacing between the nips of said rollers and its adjacent surface.

23. The machine in accordance with claim 20 wherein said machine includes an adjustment device for adjusting the spacing between said rollers.

* * * * *